US008936225B2

(12) United States Patent
Bradbury

(10) Patent No.: US 8,936,225 B2
(45) Date of Patent: Jan. 20, 2015

(54) RETRACTABLE HANGING ASSEMBLY FOR COOKWARE AND UTENSILS

(71) Applicant: Jack Finn LLC, Eagle, CO (US)

(72) Inventor: Michael S. Bradbury, Eagle, CO (US)

(73) Assignee: Michael S. Bradbury, Eagle, CO (US)

( * ) Notice: Subject to any disclaimer, the term of this patent is extended or adjusted under 35 U.S.C. 154(b) by 232 days.

(21) Appl. No.: 13/659,702

(22) Filed: Oct. 24, 2012

(65) Prior Publication Data

US 2013/0099073 A1 Apr. 25, 2013

Related U.S. Application Data

(63) Continuation-in-part of application No. 13/136,368, filed on Jul. 29, 2011, now abandoned, which is a continuation-in-part of application No. 11/983,546, filed on Nov. 9, 2007, now Pat. No. 7,766,290.

(60) Provisional application No. 60/936,077, filed on Jun. 18, 2007, provisional application No. 60/859,414, filed on Nov. 16, 2006, provisional application No. 61/628,152, filed on Oct. 24, 2011.

(51) Int. Cl.
*A47B 77/14* (2006.01)

(52) U.S. Cl.
CPC ..... *A47B 77/14* (2013.01)
USPC ..... 248/339; 248/176.1

(58) Field of Classification Search
USPC ..... 248/181.1, 176.1, 163.1, 168, 176.3, 248/187.1, 440, 160, 432, 434, 435, 317, 248/323, 339, 341
See application file for complete search history.

(56) References Cited

U.S. PATENT DOCUMENTS

| | | | | |
|---|---|---|---|---|
| 2,611,492 | A * | 9/1952 | Watts | 211/113 |
| 2,757,804 | A * | 8/1956 | Sadwin | 211/94.01 |
| 4,217,853 | A * | 8/1980 | Davitz | 118/500 |
| 4,290,531 | A * | 9/1981 | Lazarus, III | 211/85.29 |
| 4,930,188 | A * | 6/1990 | Hyde | 452/192 |
| 5,137,158 | A * | 8/1992 | Brockway | 211/106.01 |

* cited by examiner

*Primary Examiner* — Steven Marsh

(57) ABSTRACT

An apparatus for storing and retrieving cookware and utensils utilizing an assembly attached to the interior of a kitchen cabinet. The assembly is accessible by slides attached to the cabinet and incorporates hanger assembling and hanging guard assemblies whose positions are adjustable along the length of the assembly. The hanger assemblies utilize hooks that hang in a downward vertical position and are capable of rotating and pivoting around their vertical axes. The hanging guards are constructed of material that protects and separates the cookware hanging from the hanging assemblies.

8 Claims, 10 Drawing Sheets

RETRACTABLE HANGING ASSEMBLY FOR COOKWARE AND UTENSILS

CROSS-REFERENCE TO RELATED APPLICATIONS

This application claims priority to U.S. Provisional Patent Application No. 61/628,152 filed Oct. 24, 2012, and is a continuation-in-part of U.S. application Ser. No. 13/136,368 filed Jul. 29, 2011 entitled "Hanging Assembly for Cookware and Utensils with Cookware Guards," which is in turn a continuation-in-part of U.S. patent application Ser. No. 11/983,546 filed on Nov. 9, 2007 and issued on Aug. 3, 2010 under U.S. Pat. No. 7,766,290, entitled "Adjustable Assembly for Hanging Cookware and Utensils," which claims priority to U.S. Provisional Patent Application Nos. 60/936,077 filed Jun. 18, 2007 and 60/859,414 filed Nov. 16, 2006, all by inventor Michael S. Bradbury, each of which are incorporated hereby by reference.

This application is also related to U.S. patent application Ser. No. 12/821,670 filed on Jun. 23, 2010 by inventor Michael S. Bradbury.

FIELD OF INVENTION

This invention relates to cookware organizers, specifically organizers to be installed with the confines of a kitchen cabinet.

BACKGROUND OF INVENTION

Kitchen cabinet cookware and utensil storage has always been awkward, inefficient, and cumbersome. The problem of storing several different sized and shaped cookware and utensils inside cabinets has made their storage nearly impossible to do in a manner that is satisfactory for anyone who desires a neat and efficient kitchen. The problem of cookware storage has been compounded over the recent decades by the introduction and ubiquitous adaptation of non-stick cookware. This style of cookware utilizes Teflon as a non-stick surface between the cookware's metal surface and the food being cooked allowing the food to be easily removed from the cookware and ease it's cleaning. Teflon used in this manner has one major draw back: it is fragile and susceptible to damage from contact with metal utensils or the metal from other pots and pans. Teflon coated cookware also has exposed metal bottoms, sides and handles which when stacked upon each other inside of cabinets causes the damaging contact that can cause the Teflon to peal from the cooking surface thus eliminating Teflon as an advantage to the cookware.

One method of safe guarding the Teflon coating of non-stick cookware would be to not stacking the cookware in as manner that would allow metal to Teflon contact. This method of in cabinet storage would be an inefficient use of cabinet space, as each piece of cookware would need its own shelf area on the cabinet's shelves. Another alternative would be the use of a hanging cookware holder which would be mounted from the ceiling and hang in the kitchen exposed in the kitchen's open area. This method of cookware storage would leave the cookware exposed as well as consuming space in the kitchen that could be used for other purposes when the cookware is not needed. Cookware hanging in the kitchen and can he also an unsightly eyesore.

There have been several attempts in the past to help lesson the problem of kitchen, cookware and utensil cabinet storage but none have so far been satisfactory for conveniently and neatly store these items.

PRIOR ART

There have been many attempts in the past to solve the problem of cookware and utensil storage in kitchens, and these attempts can be categorized into several types of devices invented.

The most popular device utilized for cookware and utensil storage is the hanging storage rack. These types of racks are most popular in larger kitchens where they can be hung in the open space of the kitchen thus taking up useful kitchen workspace. The cookware is also exposed creating an eyesore for most who desire as neat and clean kitchen. Most of these racks have been issued a Design patent since these racks have little or no unique features to produce unexpected results to warrant a Utility patent.

In 1926 Ellberg was issued U.S. Pat. No. 1,613,447 which discusses a hanging device to have a plurality of suspension hooks suitable mounted to be relatively adjustable. Unfortunately Ellberg's invention relies on mounting brackets and strips for its application and the assemblies overall length is not adjustable thus restricting its application for the end user.

In 1931 Harris was issued U.S. Pat. No. 1,814,692 for as wall mounted telescoping utensil rack. Harris describes his rack as "comprising of telescopically associated sections supported as distance away from a wall, so that utensils or utensil covers may be arranged in the space between the wall and body of the rack". The required mounting surface Harris describes imposes a great limitation upon the rack, as it requires a sizable unobstructed vertical plane that may be difficult to accommodate in any kitchen. The rack's ability to hang large items is also limited to the length of the screw hooks as the hooks are what secures the telescoping members and away from the vertical plane creating the hanging space available.

In 1948 Watts was issued U.S. Pat. No. 2,611,492 for his hanger in strip form. Unfortunately Watt's invention only allows for pre-positioned hanger placements via sockets molded into the strip. Therefore Watts's hooks are stationary when the ball end is in the socket and are not moveable along the strip section unless the ball end is lifted vertically out of the socket. This is a clumsy arrangement in the least for changing the position of any hook of the hanger especially if any article is hanging from the hook. Depending on the article hanging from the hook the article may need to be removed in order to lift the ball end of the hook out of the socket before the move the hook could be moved to a new position.

U.S. Pat. No. 2,388,112 issued May 17, 1954 to Lewis describes an adjustable hanger for storm windows but also has other hanging applications. Lewis's hangers are individually adjustable in position along the assembly but the hooks cannot rotate or pivot to accommodate different hanging positions or ease in its use. The hooks themselves are described as flat and rectangular shaped which severely limits the types of objects that can be hung from the hooks.

U.S. Pat. No. 2,757,804 issued to Sadwin in 1956 details a new and useful improvement in clothes hanger assemblies for closets and the like. The patent is described as "a clothes hanger assembly which can readily be installed on the underside of a closet shelf or the like for slid ably supporting a plurality of clothes hangers" as well as "a clothes hanger assembly for supporting clothes or the like which will occupy but a small space in a closet". Unfortunately Sadwin's invention does not allow the hooks of his brackets to rotate and pivot. Thus Sadwin's brackets are greatly restricted in respect to the hooks capability to accommodate the needs of the user to hang items from brackets if more functionality is required than merely altering the position of the brackets along the assembly.

Sadwin also describes about his invention an elongated tubular outer box-like section and an elongated tubular inner box-like section telescopically and slid ably arranged in the outer section, Sadwin's assembly is therefore extensible in length through the ability of telescopically sliding the inner section inside of the outer section. For this arrangement to be achieved the trackways of the outer section and track ways of the inner section would not create a single plane that would allow rollers of the brackets to easily travel the length of the assembly without the obstruction of the inner section's outer wall.

In 1961 Wamsley was issued U.S. Pat. No. 2,987,289 for his hangers for suspending articles. Wamsley's invention is a hanger in which his hooks are capable of being in two positions, in a lowered resting position from where it is "easily introduced into a hooked or looped handle" of the banging article to a raised position when the weight of the article "moves the suspending member into the second position". This hanger position change action is intended for the suspended member to be "held against accidental displacement there from". Wamsley's hanger does not allow hooks to freely move along the hanger except along predetermined positions and only by removing and reintroducing hooks to the hanger. Wamsley's hungers are also unable to pivot except for the two positions mentioned above as well as completely lacking the ability to rotate. Wamsley makes no mention of his hanger being adjustable in length and thus its overall size would remain static and inconvenient for the user.

Alexander was issued U.S. Pat. No. 3,627,143 in 1971 for his invention specifically intended for hanging clothing. Alexander's hangers can only be inserted into a tube through a slot and unfortunately cannot travel the length of the tube, as the bar would fall through the slot when it comes to the slots position. Another of Alexander's embodiments is a clothes hanger of U shaped member with "two separate spaced elongated longitudinally extending slot portions". Thus again Alexander's hangers cannot freely travel the length of his clothes hanger, as there is an interruption between the slot portions. Alexander also describes "the bottom surface is provided with a plurality of transversely extending hanger positioning means for maintaining the bars" and "extending transversely with respect to the longitudinally extending slot portions". Alexander's hangers have predetermined positions along the slots thus his hangers not only cannot travel the length of the hanger but also cannot travel freely along the separate slots as the hangers travel will be interrupted by the positioning means.

U.S. Pat. No. 3,780,875 issued December 1973 to Scholl details a suspended hanger for pots and pans from an overhead surface. The device utilizes a base member and a column and a hanger assembly secured to the lower end of the column that rotates around the column. The hanger would be unable to fit inside of as conventional kitchen cabinet, as it would require a large vertically symmetric area for operating the rotational hanger feature of the device. The individual hangers cannot be independently positioned in relation to the other hangers therefore the entire device must be rotated in order to reposition the cookware.

U.S. Pat. No. 3,998,332 was issued to Lambertson on Dec. 21, 1976 that details a horizontal rack member supporting hooks. Lambertson's patent unfortunately does not allow for rotating and pivoting hooks as well as the hooks positions were not intended to be adjusted along the length of the rack while cookware is in use.

U.S. Pat. No. 4,290,531 issued Sep. 22, 1981 to Lazarus details a device for holding cooking pots and lids. The device does hang pots and lids but fails to have adjustable or moveable hooks and the hooks must work in concert with lid holders to suspend both pots and lids.

U.S. Pat. No. 4,714,166 issued Dec. 22, 1987 to Hann and Fuller details a supporting rack for cooking utensils. The rack has a framed structure that supports several hooks along its framed perimeter. The rack was intended to hang from the kitchen ceiling or from another structure providing enough structural strength and area to hang the rack and the cookware hung by it. The hooks are only able to slide along the framed perimeter and are unable to pivot and rotate. This device was envisioned for use in an open area of the kitchen and not inside of a closed structure like a cabinet.

U.S. Pat. No. 5,238,127 issued Aug. 24, 1993 to Geller details a pan holder that is attached to the ceiling, stores pans in an overhead position near the end of a flexible cantilever beam which can be pulled down to allow easy removal of the pots and pans. The holder does not however allow for adjustable hooks whereby the hooks can he moved into different positions along the holder as well as not being able to pivot and rotate. The holder is to be used in the open kitchen area and not in a closed area such as a cabinet.

U.S. Pat. No. 6,039,191 issued Jul. 2, 1997 to Purnell also details a hanging rack for being suspended from the ceiling in the open kitchen area. The structure is complicated in construction that results in a large, heavy, and expensive device for hanging cookware and utensils. The devices utilizes a plurality of bars from which it is to be hung from and hooks which are able to slide along the bars but unable to pivot and rotate.

Wangler was issued design patent Des. 392,130 in 1998 for a set of shelves with sliding tracks for hanging ornaments. Wangler's "sliding tract" is a part of the shelf itself, thus the tract cannot be added or removed from the shelf at any time and also would be a permanent fixture of the shelf and cabinet. This feature also limits the tract, as it cannot he altered in length, as it is a part of the shelf as well as the limitation of having to remove the shelves in order to add or subtract the number of hooks. Wangler makes no mention of the material from which the tracts would be constructed from other than the material of the shelves themselves. This would also be a great limitation for her inventions as cabinet shelves are generally made from particleboard or wood and thus greatly reduce the weight bearing properties of the tracts.

Another method of cookware storage incorporates the use of pull out cabinet racks. U.S. Pat. No. 3,379,484 issued April 1968 to Kilng details a pivoted rack for utensils and the like, which incorporates sheets of pegboard that can be swung outside of the cabinet storage space. Unfortunately this rack would not be functional in a cabinet that had a divider between the cabinet doors, and the hooks are only adjustable in which the positions the user had placed them prior to hanging utensils. The hanger is also cumbersome in construction and installation and is not adjustable in size therefore could not universally fit different sized cabinets.

U.S. Pat. No. 2,758,904 issued May 28, 1954 to Hansell also describes a pull out pan rack but unfortunately the product suffers from many of the same shortcomings as Kling's patent. Hansell's rack would slide in and out of the cabinet space, the rack itself constructed from pegboard or the like. The hanger is cumbersome in construction and installation and is not adjustable in size therefore could not universally lit different sized cabinets. The hooks are also only adjustable in which the positions the user had placed them prior to hanging utensils.

Another attempt to solve the kitchen cookware and utensil storage problem is the introduction of pull out hanging racks. U.S. Pat. No. 5,227,387 issued May 8, 2001 to Rose details an apparatus for supporting utensils. Rose's design allows for the rack to he pulled out of the cabinet from it's supporting base, which would be mounted inside of a cabinet. Rose's design unfortunately does not allow for adjustable hooks. Rose's hooks are fixed to one piece thus not allowing for independent positioning of the hooks along the length of the assembly as well as his hooks cannot rotate and pivot. Rose's design would make multiple cookware placement cumbersome since different pieces of cookware have different dimensions and would require different hook interval positions for each hanging piece of cookware. Rose's sound accentuating devices would also make hanging and retrieving cookware less convenient since they also have static positions along the assembly and cannot he adjusted to accommodate cookware of differing dimensions or be positioned away from cookware that is being, retrieved or stored. Thus Rose's sound attenuating devices become an obstacle for the user to retrieve and store cookware on his assembly. Rose's sound attenuating devices also cannot offer a customized fit to cookware of varying dimensions thus not allowing for smaller sized cookware to fit within larger sized cookware. This is an unfortunate design over site which causes Roses invention to not fully utilize the space saving feature of vertical nesting of cookware.

Another pull out hanging rack was patented U.S. Pat. No. 6,976,595 by Geller on Dec. 20, 2005. Geller's patent unfortunately suffers from some of the e shortcomings as Rose's patent in that the hooks remain stationary and therefore does not allow the assembly to fully accommodate the user's need in storing, and retrieving cookware. Geller's and Rose's assemblies would also require a cabinet space which is deep in length from front to back to accommodate a pull out rack of this nature, something rarely seen in any kitchen as most cabinets are wider than they are long.

Another method of storing cookware in a cabinet is the use of wire storage racks inside of the cabinet. U.S. Pat. No. 6,729,479 issued to Morgan on May 4, 2004 details a wire storage rack for pots and pans that can he mounted on a base. This style of storage unfortunately inconvenient in use since it requires the user to navigate the wires with cookware in it's storage in order to store the piece of cookware in hand. The device also uses the base of the cabinet instead of being able to hang from an overhead plane thus consuming the base of the cabinet's storage area while not offering more storage volume than a hanging device.

U.S. Pat. Nos. 7,104,409, 7,121,413, and 7,007,808 all detail wire storage racks of much the same configuration as Morgan's patent, and all unfortunately all suffer from the same short comings Morgan's patent as they are all complicated in construction and use.

OBJECTS AND ADVANTAGES

The advantages of the Pull Out Hanging Assembly for Cookware and Utensils are as follows:

(a) to provide a more efficient method to utilize the storage volume inside of a kitchen cabinet for cookware and utensil storage;

(b) to provide a more efficient and convenient method of cookware and utensil storage and retrieval for kitchen operations;

(c) to provide an improved method of cookware and utensil organization:

(d) to provide a cookware storage solution for fragile Teflon coated cookware from the damage that could occur if the cookware was to be stored in with conventional methods;

(e) to provide a banging assembly for cookware with guards to protect the cookware from damage caused by other cookware;

(f) to provide a hanging assembly that can be extended out of and reinserted into of the confines, of a kitchen cabinet.

(g) To provide a hanging assembly that can rise and be lowered when the assembly is extended from the confines of a cabinet to better accommodate the user.

(h) Further objects and advantages of my invention will become apparent from a consideration of the drawings and ensuing description.

SUMMARY

The Pull Out Hanging Assembly for Cookware and Utensils is an assembly for hanging implements with accommodating appendages in a downward pendant position inside the confines of as lower kitchen cabinet. The Assembly comprising of opposing tracks attached to the interior of a cabinet, carrier tracks from which the hanger track is attached, hanger assemblies whose positions are adjustable along length of the hanger track, hooks which hang from hanger assemblies in a downward pendant position which can rotate and pivot about their vertical axis, and hanging guards which separate the hanging cookware. Other embodiments contain more features and are described later in further detail.

REFERENCE NUMERALS

Figure 1:
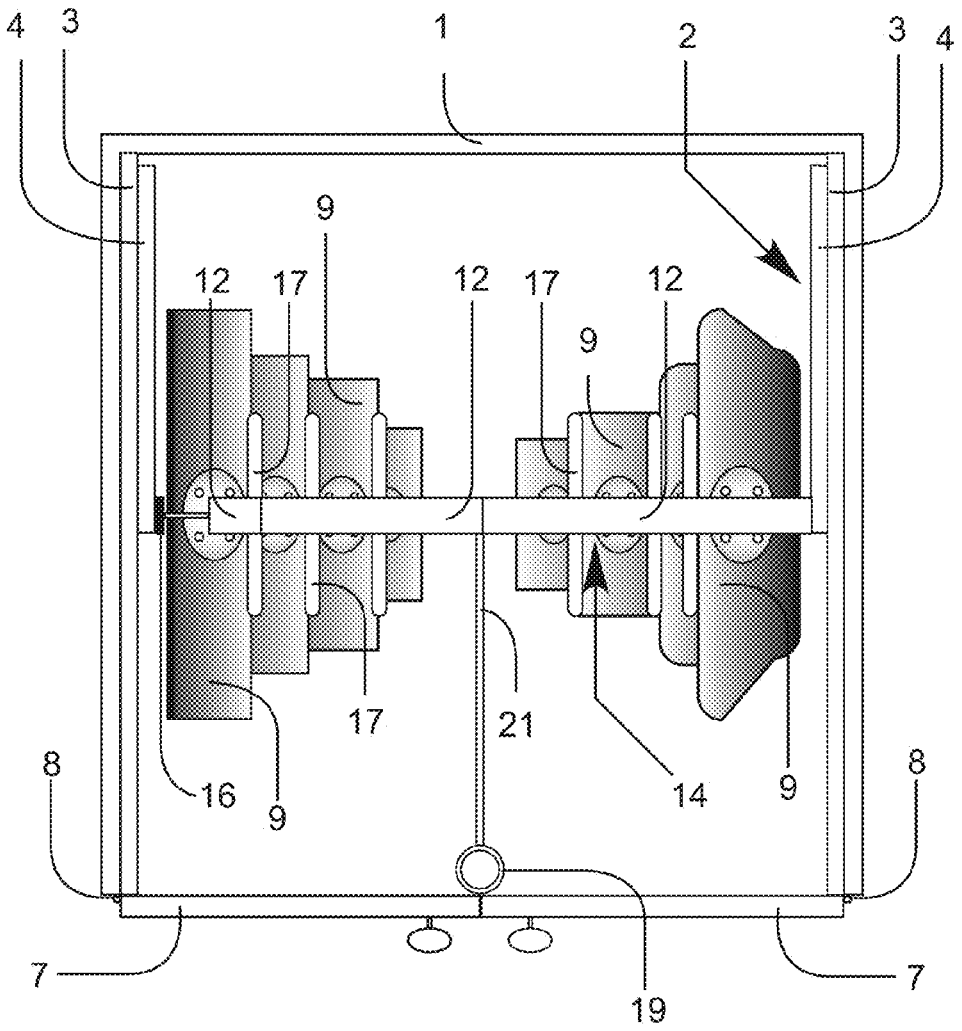
FIG. 1 is a top view of the retractable cabinet hanger assembly with an adjustable track; the assembly rests inside the confines of the cabinet.
Figure 2:
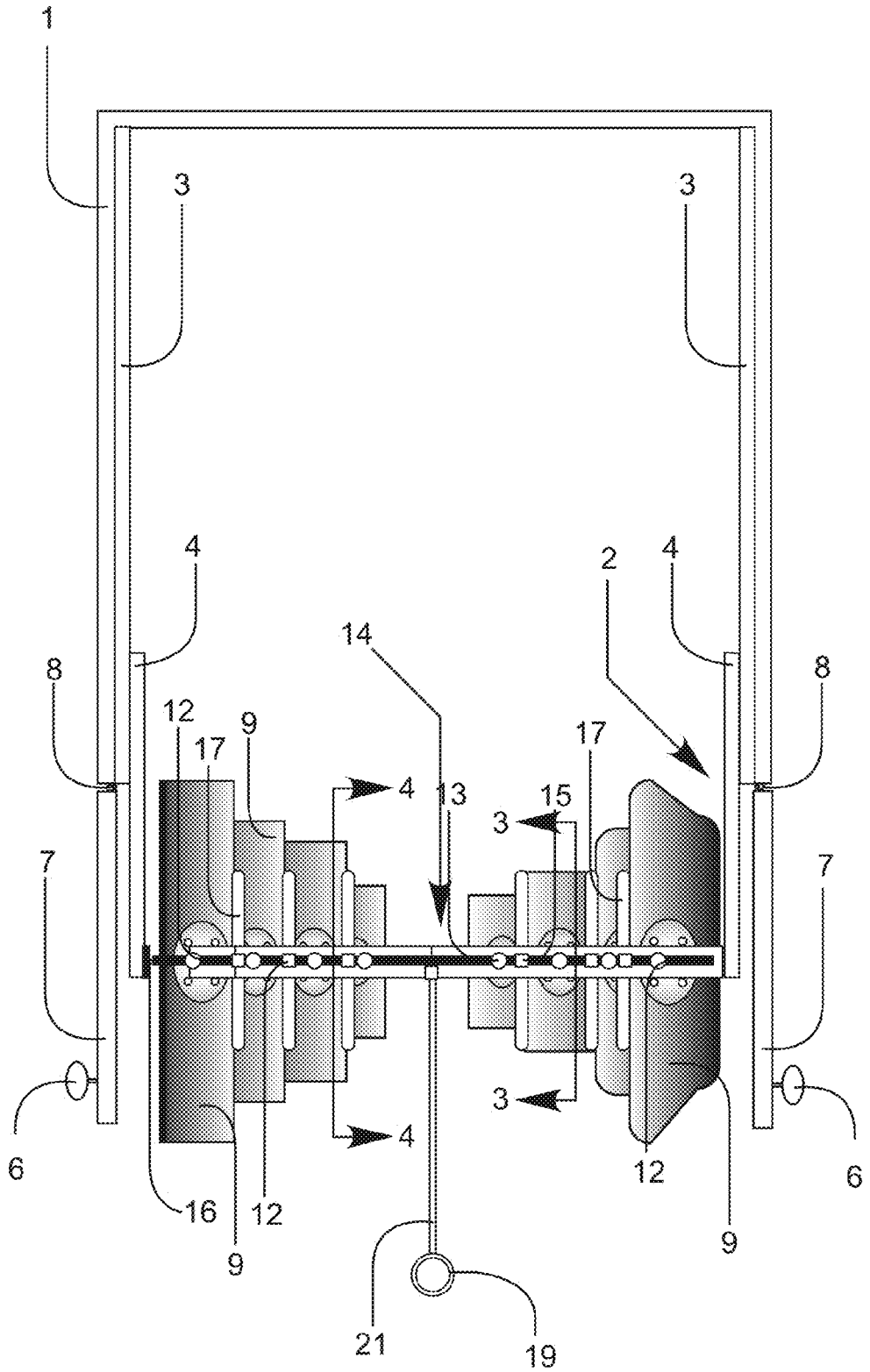
FIG. 2 is a top view of the retractable cabinet hanger assembly with an adjustable track; the hanger assembly is fully extended out from the confines of the cabinet.
Figure 3:
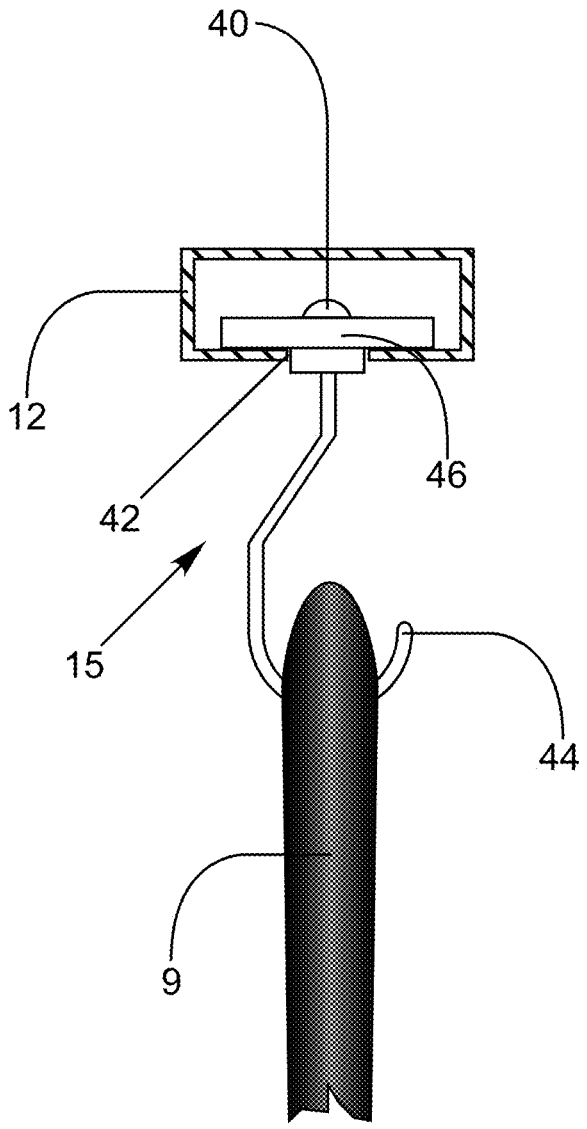
FIG. 3 is a cross section from FIG. 1 detailing a hanger assembly and hanger track.
Figure 4:
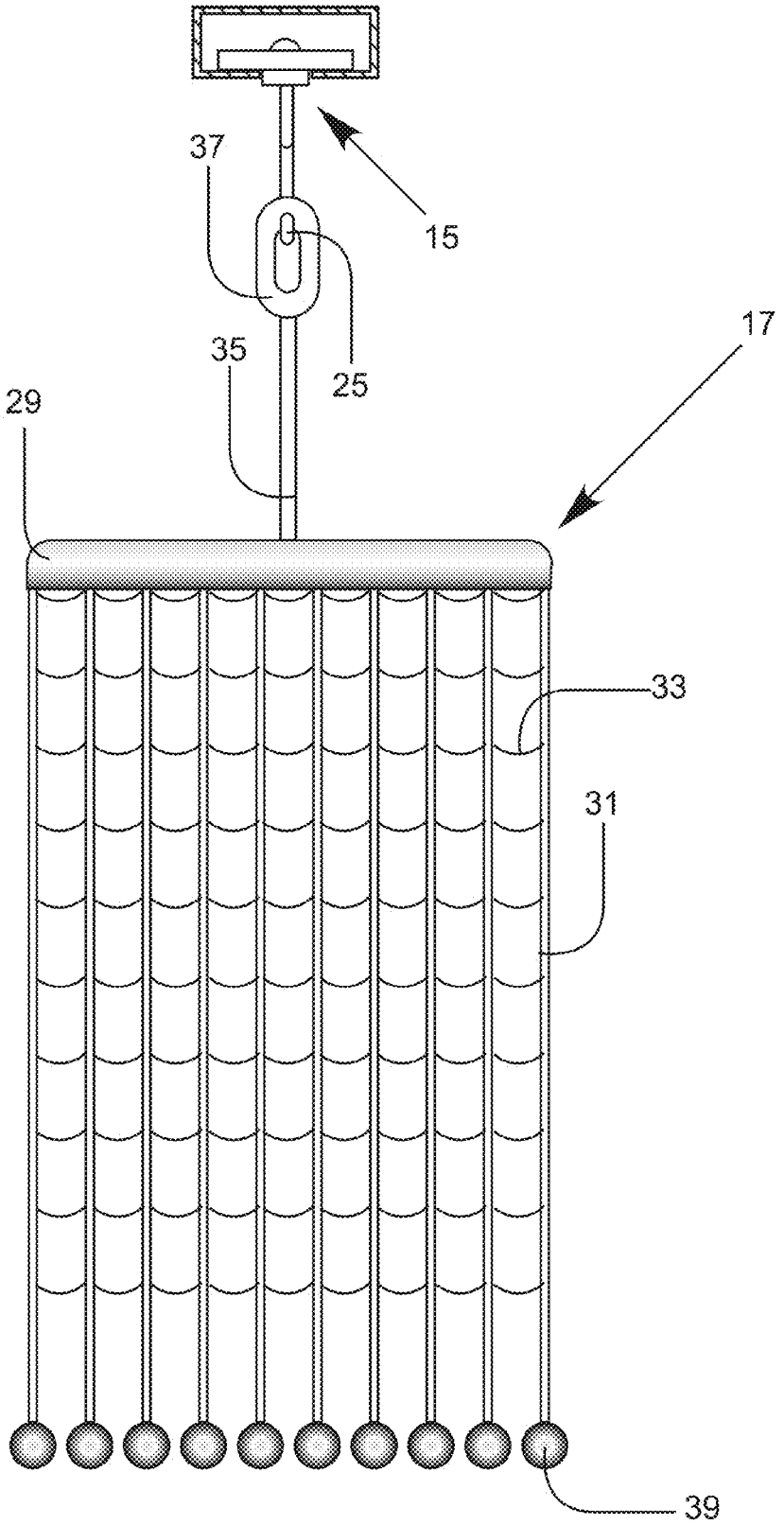
FIG. 4 is a cross section from FIG. 2 detailing hanger guard and hanger track detailing the components from which the guard is composed.
Figure 5:
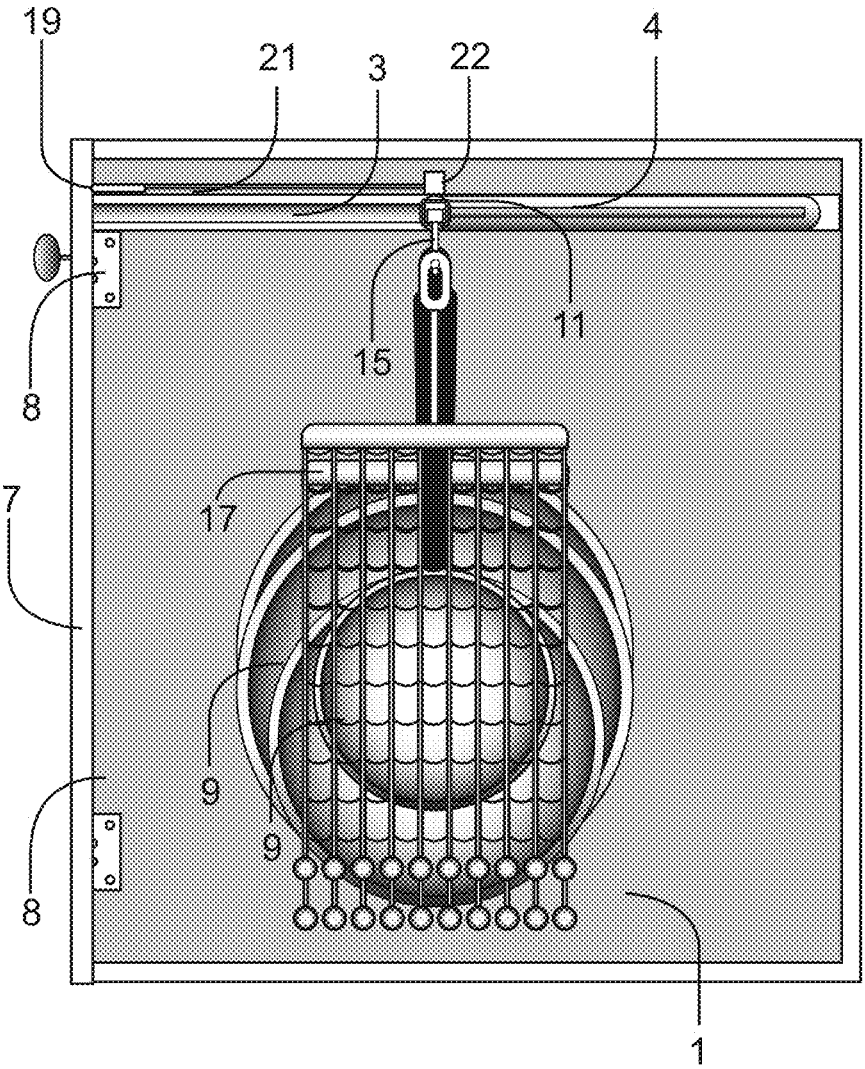
FIG. 5 is a side view of the retractable cabinet hanger assembly with a non-adjustable hanger track; the hanger assembly rests inside the confines of the cabinet.
Figure 6:
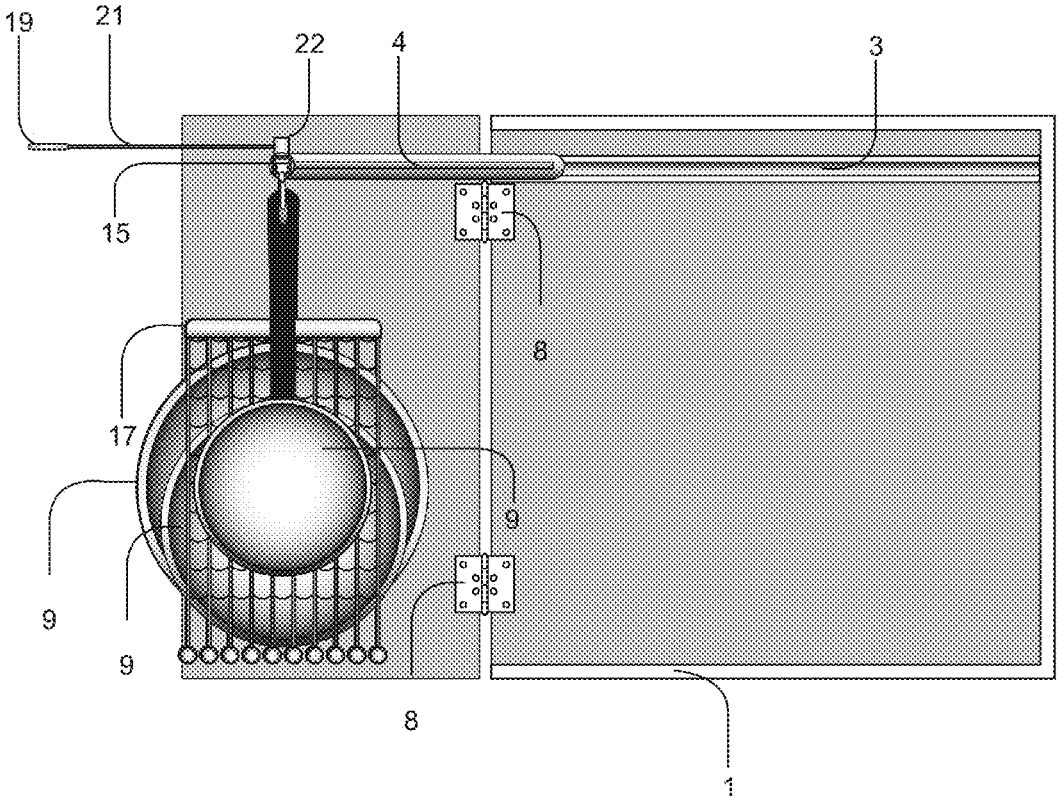
FIG. 6 is a side view of the retractable cabinet hangar assembly with a non-adjustable hanger track; the hanger assembly rests inside the confines of the cabinet.

1. Cabinet
2. Retractable track assembly
3. Cabinet mounted track
4. Carrier track
5. Pivot Rod
6. Cabinet doorknob
7. Cabinet door
8. Cabinet door hinge

9. Cookware
11. Hanger track one piece
12. Hanger track section
13. Hanger track gap
14. Sectioned hanger track assembly
15. Hanger assembly
16. Hanger track assembly length adjuster
17. Hanger guard assembly
18. Retractable track assembly one piece
19. Hanger assembly pullout ring
21 Hanger assembly pullout rod
22. Hanger assembly pullout rod housing
23. Hanger track lifter
25. Hanger hook
27. Hanger hook slide
29. Hanger guard shoulder
31. Guard strand
33. Guard strand condenser
35. Guard hanger rod
37. Guard hanger assembly attachment
39. Guard strand weight
40. Rotating pivot
42. Track slot
44. Hanger hook
46. Hanger slider

PREFERRED EMBODIMENTS

Referring to FIGS. 1-6 for the following description of the Retractable Hanging Assembly for Cookware and Utensils, Cabinet mounted tracks (3) are mounted on the inside of a lower cabinet (1) on opposing vertical sides in a manner that both tracks (3) are level and at the same height relative to the top of cabinet (1). Carrier tracks (4) are attached to Cabinet mounted tracks (3) in at manner that Carrier tracks (4) can be slid in and out of Cabinet mounted tracks (3) and thus in and out of the Cabinet (1) doorway. The Carrier tracks (4) ends closest to Cabinet door (7) are connected to either ends of Sectioned hanger track assembly (14) in a manner that when the Hanger assembly (14) is pulled out of or back into Cabinet (1) both Carrier tracks (4) follow the position of Track assembly (14) in unison.

Hanger Slider (46), Rotating Pivot (40), and Hanger Hook (44) are all assembled as one unit as a Hanger Assembly (15). Hanger Assemblies (15) are coupled to a Hanger track section (12) of the Sectioned hanger track assembly (14) by the Hanger Slider (46) and are capable of sliding, freely along the length of the Track assembly (14). Rotating Pivot (40) allows the Hanger Hook (44) to rotate and pivot a predetermined number of degrees from the Hooks (44) vertical axis. Hanger assemblies (15) are attached to the Hanger track sections (12) that are connected together and comprise the Sectioned hanger track assembly (14) in a manner that the Hanger assemblies (15) are able to slide the length of Section assembly (14). Hanger track assembly length adjuster (16) is attached to either side of the Hanger track section assembly (14) and is capable of adjusting the overall length of the assembly (14) to better lit the Assembly (14) into the cabinet. The junctions where the Hanger track sections (12) connect do so in a manner that the Hanger assemblies (15) can travel between connected Track sections (12) without impedance. The number of Hanger assemblies (15) may also be adjusted by the addition or removal of Assemblies (15) from Sectioned hanger track assembly (14).

Hanger Assemblies (15) may also hang and support Hanger guard assemblies (17) between Hanger Assemblies (15) that hang and support Cookware (9) in order for the Guard assemblies (17) to provide a protective harrier between hanging Cookware (9). Hanger guard assemblies (17) are comprised of a Guard hanger assembly attachment (37) that connects the Hanger guard assemblies (17) to the Hanger assemblies (15), a Guard hanger rod (35) which is connected to the Attachment (37) at top end and a Hanger guard shoulder (29) at the bottom end. The Hanger guard shoulder (29) has a series of Guard strands (31) that connected to and hang in a downward pendant position from shoulder (29). Guard strands (31) are laterally connected to Guard strand condensers (33), which provide lateral support to Strands (31) and will allow for slight deformation of Strands (31) towards the shape of the cookware pressing against the Guard assembly (17). Guard strand weights (39) are attached to the lower ends of Guard strands (31) and provide a downward three to the Strands (31) to prevent Strands (31) and Strands condensers (33) from becoming tangled with each other or adjacent cookware (9).

Refer to FIGS. 1-6 for the following operation of the Retractable Hanging Assembly for Cookware and Utensils. The Sectioned hanger track assembly (14) rests within the confines of a kitchen cabinet (1) with the Cabinet doors (7) in the closed position. Hanger slider (46). Rotating pivot (40), and Hanger hook (44) are all assembled as one unit as a Hanger assembly (15). Rotating pivot (40) allows the Hanger hook (44) to rotate and pivot a predetermined number of degrees from the Hooks (44) vertical axis. The Hanger hooks (44) allows for any Cookware (9) or Hanger guard assemblies (17) to hang from the Assemblies (15). Cookware and utensils can also be rotated as well as pivot around the Hanger hooks (44) vertical axis through the Pivot (40).

Hanger assemblies (15) are coupled to a Hanger track section (12) of the Sectioned hanger track assembly (14) by the Hanger slider (46) and are capable of sliding freely along the Hanger track sections (12) that comprise the Sectioned hanger track assembly (14). Cookware (9) and Hanger guard assemblies (17) hanging from the Assemblies (15) and are also able be moved freely along the length of the Sectioned hanger track assembly (14) with the positions of the Assemblies (15). The movable positions of the Cookware (9) and Guard assemblies (17) combined with the ability to rotate and pivot will allow the user the ability to better manage the storage volume inside the cabinet by manipulating the positions and placement of the Cookware (9) and the Hanger guard assemblies (17) as well as ease the job of storage and retrieval of the Cookware (9). The number of Hanger assemblies (15) and Hanging guard assemblies may also be adjusted by the addition or removal of Assemblies (15) from Retractable track assembly (2).

Hanger guard assemblies (17) bang from Hanger assemblies (15) and provide a protective barrier between pieces of Cookware (9) such that the Cookware (9) cannot contact each other.

As the cookware (9) is hung from the Hanging assemblies (15) and positioned along the Hanging assembly (14) the Guard assemblies (17) prevent the cookware (9) from contacting one another and thus prevents damage to the cookware (9) caused by metal to Teflon contact. Guard strands (31) and Guard strand condensers (33) expand to cover the shape of adjacent Cookware (9) that contacts the Guard assembly (17) to form a fitting protective barrier between Cookware (9) hanging from adjacent Hanger assemblies (15). The flexible nature of the Guards (17) allow for vertical nesting of the cookware without risk of damage to the Teflon coating of the cookware thus allowing for maximizing the utilization of the area the Retractable track assembly (2) has to store cookware.

The Sectioned hanger track assembly (14) is attached to two Carrier tracks (4) on either side of the Sectioned hanger track assembly (14), both Carrier tracks (4) are slid ably coupled to Cabinet mounted tracks (3) and slide in concert with the Track assembly (14). Both the Sectioned hanger track assembly (14) and the Carrier tracks (4) can be pulled out from the confines of a lower kitchen cabinet (1) when the Cabinet doors (7) are open and inserted back into the cabinet such that the Cabinet doors (7) can be closed. When the Hanger assembly (14) and the Carrier tracks (4) are fully pulled out from the confines of the Cabinet (1) the user can then add or remove Cookware (9) from the Track assembly (14).

Figure 7:
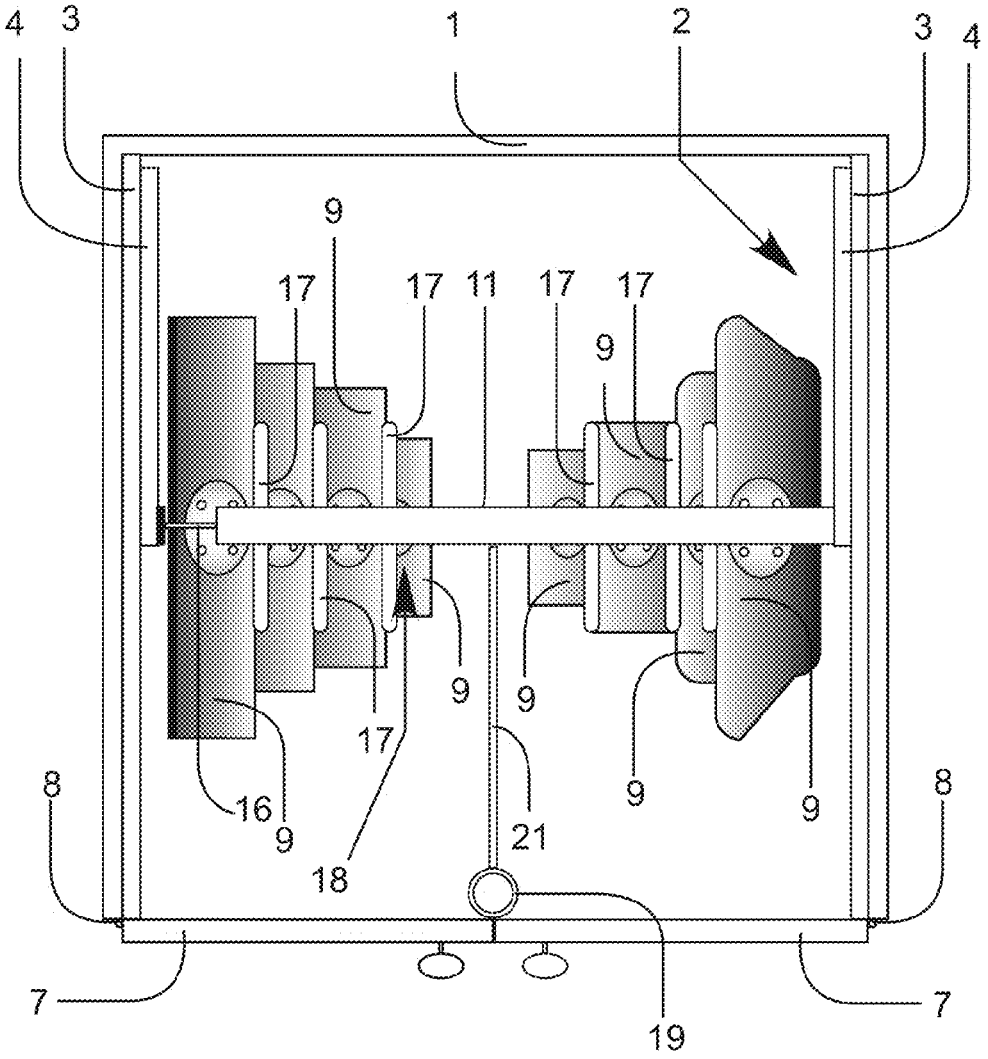
FIG. 7 is a top view of the retractable cabinet hanger assembly with a non-adjustable hanger track; the hanger assembly rests inside the confines of the cabinet.
Figure 8:
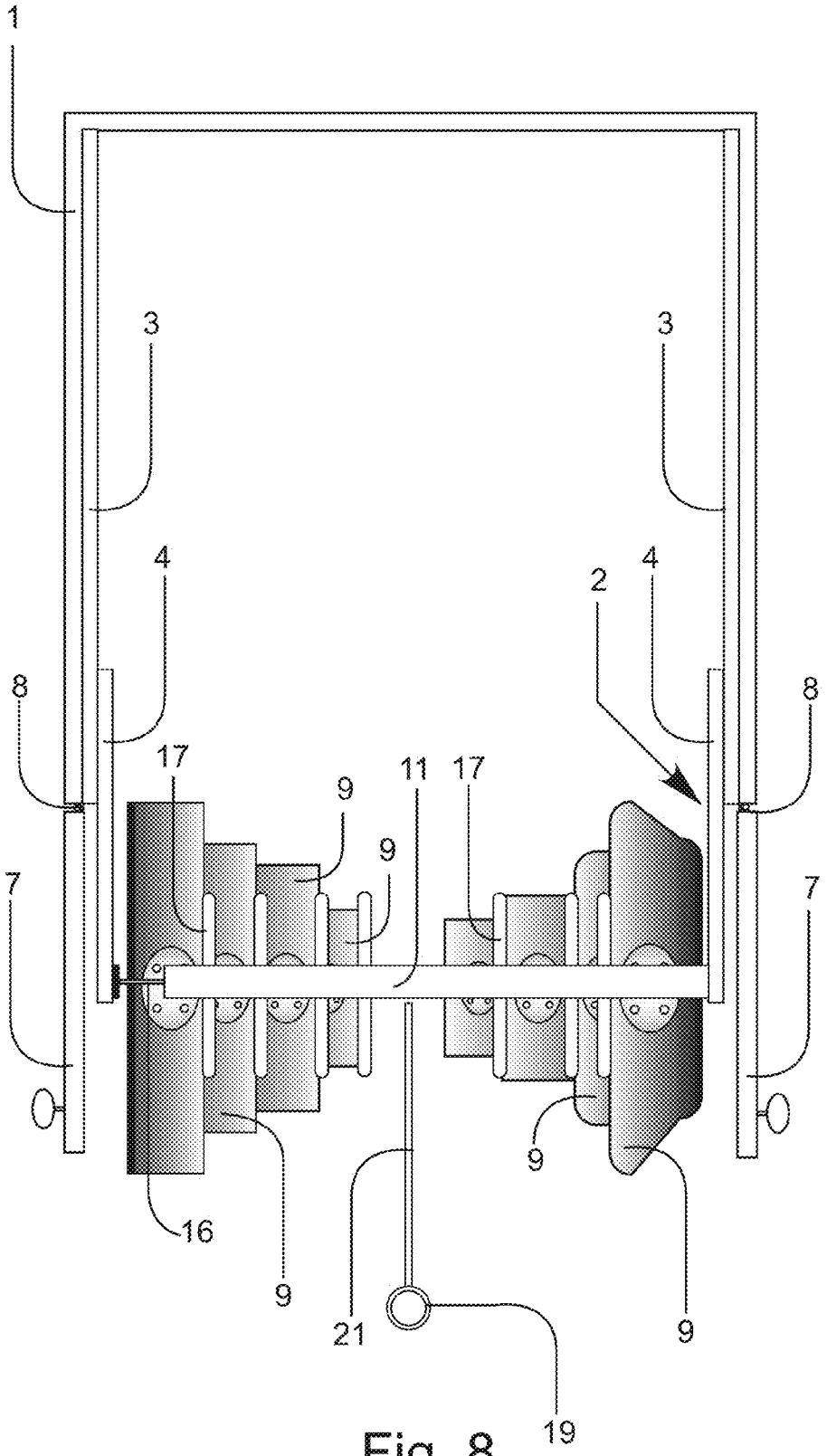
FIG. 8 is a top view of the retractable cabinet hanger assembly with a non-adjustable hanger track; the hanger assembly is extended out from the confines of the cabinet.

Referring to FIGS. 7-8 for the Retractable Cabinet Hanger Assembly with a Non-Adjustable Hanger Track. Cabinet mounted tracks (3) are mounted on the inside of a lower cabinet (1) on opposing vertical sides in a manner that both tracks (3) are level and at the same height relative to the to of cabinet (1). Carrier tracks (4) are attached to Cabinet mounted tracks (3) in as manner that Carrier tracks (4) can be slid in and out of Cabinet mounted tracks (3) and thus in and out of the Cabinet (1) doorway. The Carrier tracks (4) ends closest to Cabinet door (7) are connected to either ends of Retractable track assembly one piece (18) in a manner that when the Hanger assembly (18) is pulled out of or hack into Cabinet (1) both Carrier tracks (4) follow the position of Track assembly (18) in unison.

Hanger Slider (46), Rotating Pivot (40), and Hanger Hook (44) are all assembled as one unit as a Hanger Assembly (15). Hanger Assemblies (15) are coupled to as Hanger track one piece (11) of the Retractable track assembly one piece (18) by the Hanger Slider (46) and are capable of sliding freely along the length of the Hanger track one piece (11). Rotating Pivot (40) allows the Hanger Hook (44) to rotate and pivot a predetermined number of degrees from the Hooks (44) vertical axis. Hanger track assembly length adjuster (16) is attached to either side of the Hanger track one piece (11) and is capable of adjusting the overall length of the Hanger track one piece (11) to better fit the assembly (18) into the cabinet. The number of Hanger assemblies (15) may also be adjusted by the addition or removal of Assemblies (15) from Hanger track one piece (11). Hanger Assemblies (15) may also hang and support Hanger guard assemblies (17) between Hanger Assemblies (15) that hang and support Cookware (9) in order for the Guard assemblies (17) to provide a protective barrier between hanging Cookware (9). Hanger guard assemblies (17) are comprised of, Guard hanger assembly attachment (37) that connects the Hanger guard assemblies (17) to the Hanger assemblies (15), a Guard hanger rod (35) which is connected to attachment (37) at top end and a Hanger guard shoulder (29) at the bottom end. The Hanger guard shoulder (29) has a series of Guard strands (31) that connected to and hang in a downward pendant position from shoulder (29). Guard strands (31) are laterally connected to Guard strand condensers (33), which provide lateral support to Strands (31) and will allow for slight deformation of Strands (31) towards the shape of the cookware pressing against the Guard assembly (17). Guard strand weights (39) are attached to the lower ends of Guard strands (31) and provide a downward force to the Strands (31) to prevent Strands (31) and Strands condensers (33) from becoming tangled with each other or adjacent cookware (9).

Figure 9:
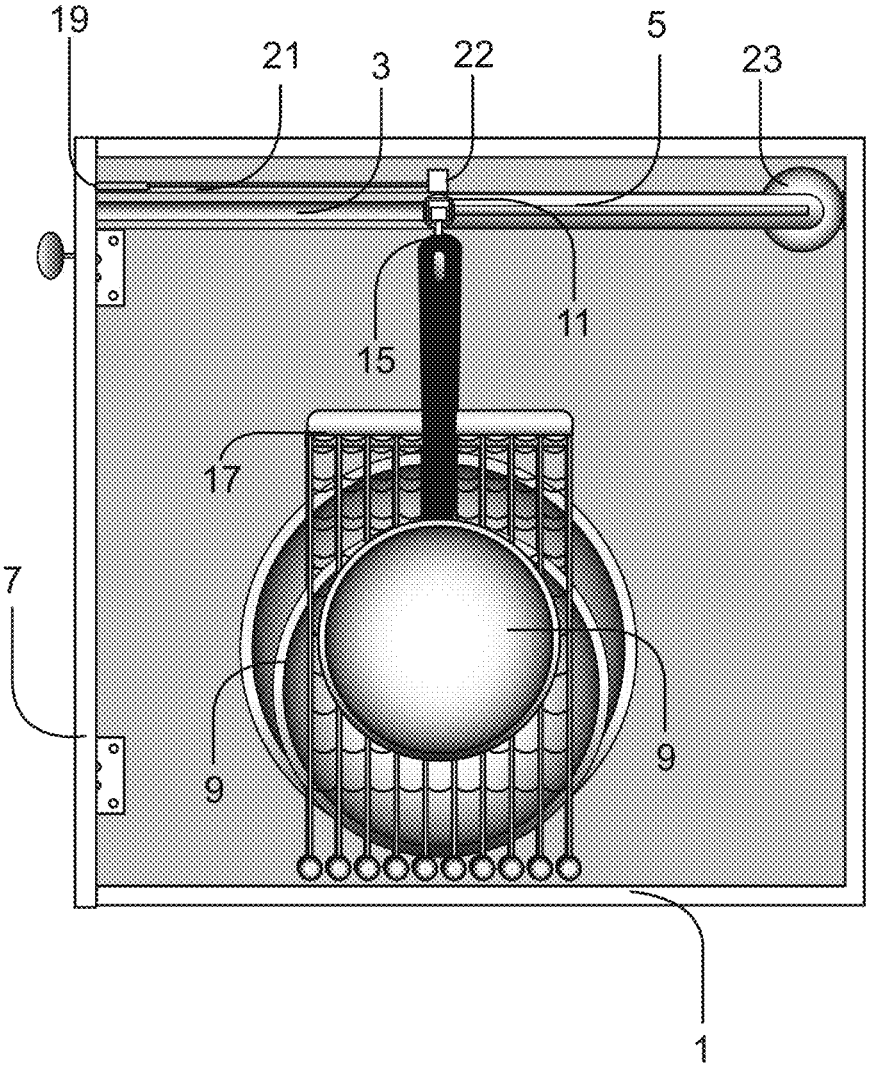
FIG. 9 is a side view of the retractable cabinet hanger assembly with track lifters; the hanger assembly rests inside the confines of the cabinet.
Figure 10:
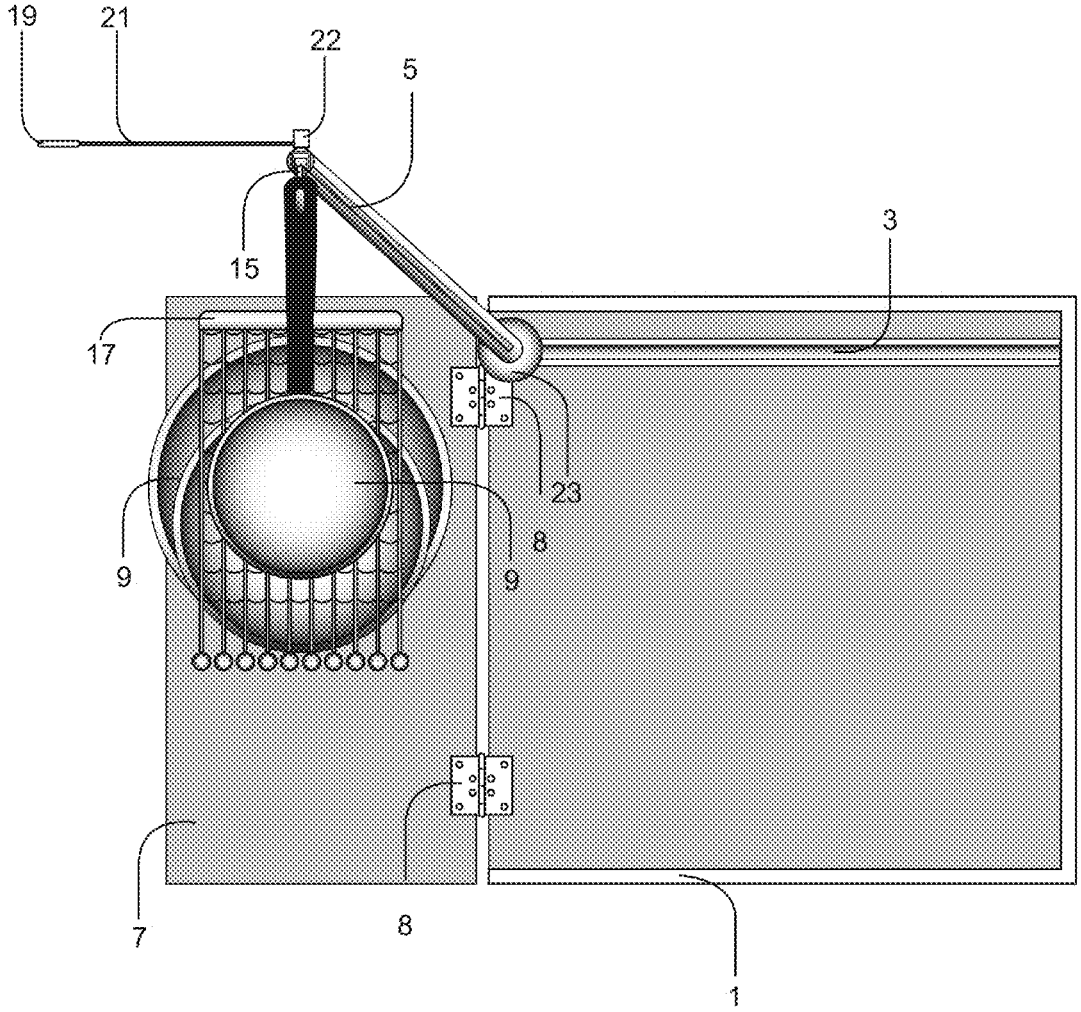
FIG. 10 is a side view of the retractable cabinet hanger assembly with lifters; the hanger assembly is fully extended out from the confines of the cabinet.

Refer to FIGS. 9-10 for the Retracting Hanging Assembly for Cookware and Utensils Third Embodiment with Hanger track lifters (23). Two Cabinet two mounted tracks (3) are attached onto opposing vertical surfaces inside of the lower cabinet (1). Carrier tracks (4) are attached to and supported by Tracks (3) in a manner that Carrier tracks (4) are allowed to slide outward towards the exterior environment of the cabinet through the opening the Cabinet door (7) encloses when door (7) is open. Both ends of Hanger track one piece (11) are attached to the outward ends of both opposing Carrier tracks (4) in a manner that when the Hanger track one piece (11) is protracted out from the interior of the cabinet (1) both Carrier tracks (4) extend from Tracks (3) in unison.

Hanger Slider (46), Rotating Pivot (40), and Hanger Hook (44) are all assembled as one unit as a Hanger Assembly (15). Hanger Assemblies (15) are coupled to the Hanger Track (11) by the Hanger Slider (46) and are capable of sliding freely along the length of the Track (11). Rotating Pivot (40) allows the Hanger Hook (44) to rotate and pivot as predetermined number of degrees from the Hooks (44) vertical axis.

Hanger Assemblies (15) also may hang and support Hanger guard assemblies (17) at intermittent intervals between Hanger Assemblies (15) that hang and support cookware (9) in order for the Guard assemblies (17) to provide a protective barrier between cookware. Hanger guard assemblies (17) are comprised of Guard hanger assembly attachment (37) that connects the Hanger guard assemblies (17) to the Hanger assemblies (15), a Guard hanger rod (35) which is connected to attachments (37) at top end and a Hanger guard shoulder (29) at the bottom end. The Hanger guard shoulder (29) has a series of Guard strands (31) that connected to and hang in a downward pendant position from shoulder (29). Guard strands (31) are laterally connected to Guard strand condensers (33). Condensers (33) provide elastic lateral support to Strands (31) and with Strands (31) will allow for slight deformation of Strands (31) to towards the shape of the cookware pressing against the Guard assembly (17). Guard strand weights (39) are attached to the lower ends of Guard strands (31) and provide a downward three to the Strands (31) to prevent Strands (31) and Strands condensers (33) from becoming tangled with each other or adjacent cookware (9).

When the Hanger track (11) is pulled out from the interior of the cabinet (1) the Hanger track lifters (23) raise the Hanger Track one piece to the elevated position. Hanger track lifters (23) allow for the Carrier tracks (4) to raise in unison the Hanger track one piece (11) a predetermined number of degrees from the horizontal axis of the Cabinet mounted tracks (3) through a pivoting motion. Cookware (9) hanging from the Hanger assemblies (15) can now be easily accessed or stored by the user.

Hanger Slider (46), Rotating Pivot (40), and Hanger Hook (44) are assembled as one unit as a Hanger Assembly (15). Hanger Assemblies (15) are coupled to the Hanger Track (11) by the Hanger Slider (46) and are capable of sliding freely along the length of the Track (11). Rotating Pivot (40) allows the Hanger Hook (44) to rotate and pivot a predetermined number of degrees from the Hooks (44) vertical axis.

Hanger Assemblies (15) also may hang and support Hanger guard assemblies (17) at intermittent intervals between Hanger Assemblies (15) that hang and support cookware (9) in order for the Guard assemblies (17) to provide a protective barrier between cookware. Hanger guard assemblies (17) are comprised of, Guard hanger assembly attachment (37) that connects the Hanger guard assemblies (17) to the Hanger assemblies (15), a Guard hanger rod (35) which is connected to attachments (37) at top end and a Hanger guard shoulder (29) at the bottom end. The Hanger guard shoulder (29) has a series of Guard strands (31) that connected to and hang in a downward pendant position from shoulder (29). Guard strands (31) are laterally connected to Guard strand condensers (33). Condensers (33) provide elastic lateral support to Strands (31) and with Strands (31) will allow for slight deformation of Strands (31) to towards the shape of the cookware pressing against the Guard assembly (17). Guard strand weights (39) are attached to the lower ends of Guard strands (31) and provide a downward force to the Strands (31) to prevent Strands (31) and Strands condensers (33) from becoming tangled with each other or adjacent cookware (9).

The invention claimed is:

1. A retractable cookware and utensil hanging assembly for kitchen lower cabinets comprising:

A plurality of tracks mounted inside of a cabinet on opposing vertical sides whereby said tracks are equidistant and level from a bottom plane of said cabinet;

two carrier tracks attached to said tracks in a manner that said carrier tracks are able to slide into and out from said tracks;

a hanger track assembly comprising of a single hanger track, said hanger track is attached to said carrier tracks;

a plurality of hanger assemblies, each comprising of:

a hanger sliding mechanism configured to slidably couple said hanger assemblies to said hanger track assembly; and a hooking mechanism configured to hold articles in a downward pendant position;

a pivot mechanism, wherein the pivot mechanism is able to pivot said hooking mechanism a predetermined number of degrees out from a central vertical axis of said pivot mechanism and wherein the pivot mechanism is able to rotate said hooking mechanism at least 90 degrees around said vertical central axis;

a plurality of hanging assembly hanging guards, each comprising of: at least one hanging assembly hanging guard that is attachable to said hooking mechanism of said hanger assemblies, said hanging guard hanging assembly hangs in a downward pendant position whereby the guard provides a protective barrier between articles hanging from adjacent said hanger assemblies.

2. The cookware hanging assembly from claim 1 further including a track assembly length adjuster attached between said hanger track assembly and said carrier track, said track assembly length adjuster can be increased or decreased in length to better fit said hanger track assembly to said carrier tracks.

3. The cookware hanging assembly from claim 1 whereby said hanger track assembly is a sectioned hanger track assembly comprising of hanger track sections, said sectioned hanger track assembly can be adjusted in length by the addition or subtraction of said track sections, said sectioned hanger track assembly is attached on either end to said carrier tracks.

4. The assembly from claim 3 further including a track assembly length adjuster attached between said hanger track assembly and said carrier track, said track assembly length adjuster can be increased or decreased in length to better fit said hanger track assembly to said carrier tracks.

5. A retractable cookware and utensil hanging assembly for kitchen lower cabinets comprising:

a plurality of cabinet mounted tracks mounted inside of a kitchen lower cabinet on opposing vertical sides in a manner that both said cabinet mounted tracks are level and at the same height relative to said cabinet; and a plurality of carrier track pivots sidadbly coupled to said cabinet mounted tracks in a manner that said carrier track pivots are able to be positioned along predetermined positions of said cabinet mounted tracks; and two carrier tracks attached to said carrier track pivots, said carrier track pivots can rotate said carrier tracks a predetermined number of degrees upward from and return to a horizontal axis of said cabinet mounted tracks when said carrier tracks and said carrier track pivots are in an outside position from the confines of said cabinet interior; and a hanger track assembly comprising of a single hanger track, ends of said hanger track assembly are attached on either end to said carrier tracks; and a plurality of hanger assemblies, each comprising of:

a hanger sliding mechanism configured to slidably couple said hanger assemblies to said hanger track assembly; and a hooking mechanism configured to hold articles in a downward pendant position; and a pivot mechanism, wherein the pivot mechanism is able to pivot said hooking mechanism a predetermined number of degrees out from central vertical axis of said pivot mechanism and wherein the pivot mechanism is able to rotate said hooking mechanism at least 90 degrees around said vertical central axis; and a plurality of hanging assembly hanging guards, each comprising of:

at least one hanging assembly hanging guard that is attachable to said hooking mechanism of said hanger assemblies, said hanging guard hanging assembly hangs in a downward pendant position whereby the guard provides a protective barrier between articles hanging from adjacent said hanger assemblies.

6. The cookware hanging assembly from claim 5 further including a track assembly length adjuster attached between said hanger track assembly and said carrier track, said track assembly length adjuster can be increased or decreased in length to better fit said hanger track assembly to said carrier tracks.

7. The cookware hanging assembly from claim 5 whereby said hanger track assembly is a sectioned hanger track assembly comprising of hanger track sections, said sectioned hanger track assembly can be adjusted in length by the addition or subtraction of said track sections, said sectioned hanger track assembly is attached on either end to said carrier tracks.

8. The assembly from claim 7 further including a track assembly length adjuster attached between said hanger track assembly and said carrier track, said track assembly length adjuster can be increased or decreased in length to better fit said hanger track assembly to said carrier tracks.

* * * * *